US006068385A

United States Patent [19]

Hsieh

[11] Patent Number: 6,068,385

[45] Date of Patent: May 30, 2000

[54] DURABLE LAMP HAVING AIR COOLED MOVEABLE BULB

[76] Inventor: Jordan Hsieh, 5F, No, 47, Lin-yi Street, Taipei, Taiwan

[21] Appl. No.: 09/044,402

[22] Filed: Mar. 18, 1998

[51] Int. Cl.[7] ..... F21V 29/00

[52] U.S. Cl. ..... 362/188; 362/288; 362/294; 362/373

[58] Field of Search ..... 362/188, 294, 362/288, 373

[56] References Cited

U.S. PATENT DOCUMENTS

| | | | |
|---|---|---|---|
| 1,286,590 | 12/1918 | Grether | 362/188 |
| 1,859,481 | 5/1932 | Voorhees | 362/188 |
| 3,299,884 | 1/1967 | Moore et al. | 362/294 X |
| 4,321,659 | 3/1982 | Wheeler | 362/293 |
| 4,344,112 | 8/1982 | Brown | 362/96 |
| 4,546,420 | 10/1985 | Wheeler et al. | 362/268 |
| 5,055,697 | 10/1991 | Manoogian et al. | 362/373 X |
| 5,111,367 | 5/1992 | Churchill | 362/32 |

*Primary Examiner*—Laura K. Tso
*Attorney, Agent, or Firm*—Doughterty & Troxell

[57] ABSTRACT

A durable lamp, comprising: a hollow main body with a front end, having an inner cavity, which towards the front end forms an open accommodating space; a light bulb, mounted in the accommodating space; a light filter, mounted in front of the light bulb; and a fan, mounted in the cavity, for directing air from outside the main body through the cavity along a ventilation path that passes the light bulb, so as to cool the light bulb during operation.

7 Claims, 1 Drawing Sheet

DURABLE LAMP HAVING AIR COOLED MOVEABLE BULB

BACKGROUND OF THE INVENTION

1. Field of the Invention

The present invention relates to a durable lamp, particularly to a durable lamp, which is of simple structure and easy to use.

2. Description of Related Art

The following description takes an ultraviolet lamp as an example. Ultraviolet lamps are often used next to closed spaces, like cooling coils or tubes for liquids, in order to help to find leaks or to test for fluorescent particles in food or clothes. Fluorescent particles radiate visibly, when exposed to blue or ultraviolet light and are thus easy to detect. This is used to test tubes for leaks or to test food and clothes for fluorescent particles.

The biggest problem of conventional ultraviolet lamps is that considerable heat is generated during use. If the heat is not properly dissipated, the lamp is easily burnt. Conventional ultraviolet lamps, however, have a casing provided with holes to dissipate heat, which are not sufficient for cooling. So the lifetime of conventional ultraviolet lamps is shortened considerably, often being reduced to as little as a few hours.

Furthermore, the casing of conventional ultraviolet lamps is made of iron or hard plastic, having a large volume, but no protection against shock. During use in a confined space, conventional ultraviolet lamps are often bumped against hard material or dropped, causing them to be damaged.

SUMMARY OF THE INVENTION

The main object of the present invention is to provide a durable lamp with improved heat dissipation to enhance the lifetime of the lamp.

Another object of the present invention is to provide a durable lamp of small volume and of improved resistance against shock.

The present invention can be more fully understood by reference to the following description and accompanying drawings.

DETAILED DESCRIPTION OF THE PREFERRED EMBODIMENT

Figure 1:
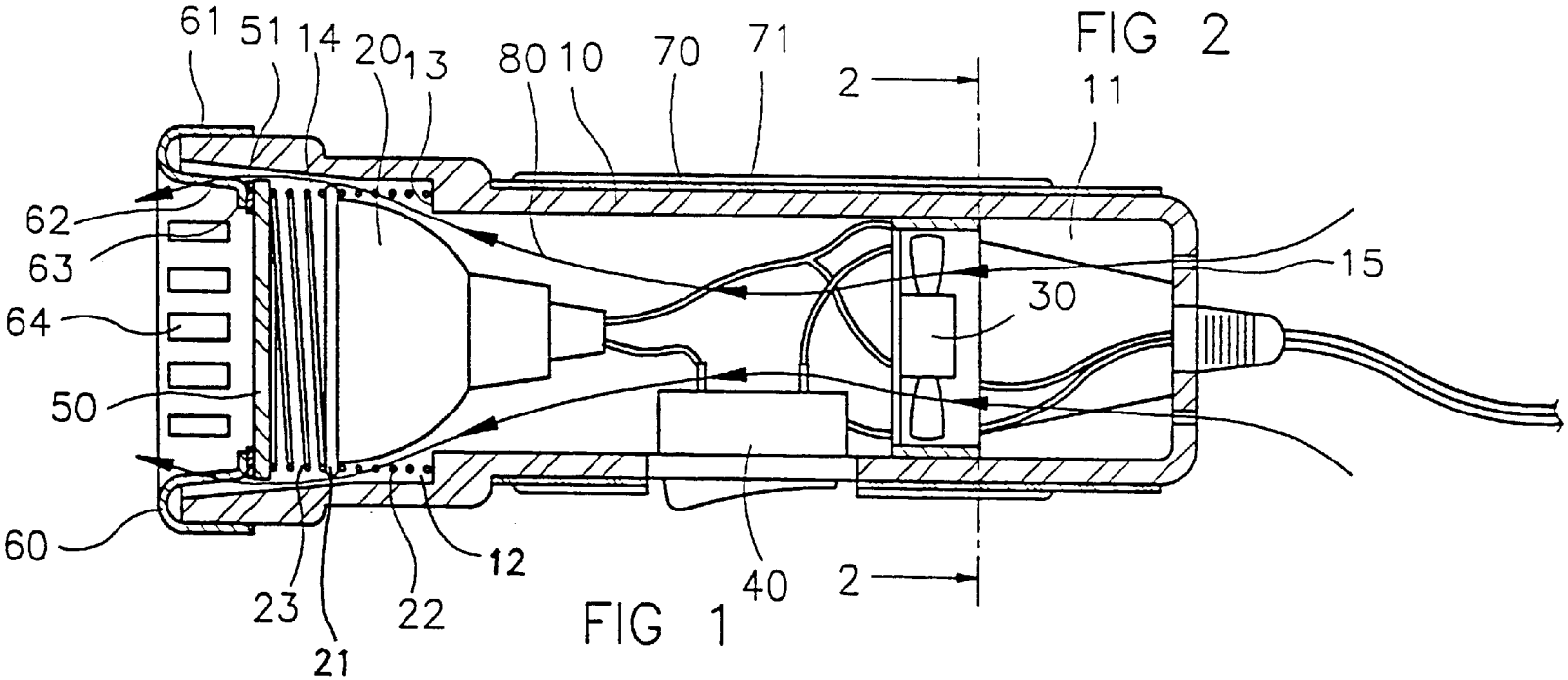
FIG. 1 is a sectional view of the durable lamp of the present invention.

As shown in FIG. 1, the durable lamp of the present invention is a ultraviolet lamp, shaped like a flashlight, mainly comprising: a main body 10; a light bulb 20; a fan 30; a power switch 40; a light filter 50; and a holding ring 60 for fastening the light bulb 20 and the light filter 50 on the main body 10.

Figure 2:
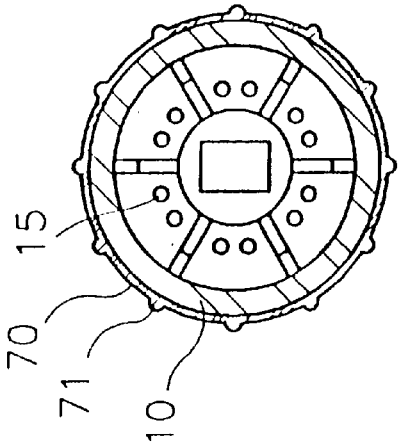
FIG. 2 is a cross-sectional view along line 2—2 of FIG. 1.

Referring to FIGS. 1 and 2, the main body 10 is roughly of cylindrical shape with a longitudinal axis, having a front end, a rear end and a curved surface, which is held by the hand of a user. The power switch 40 is fastened to the main body 10 and is used to switch the light bulb 20 and the fan 30 on and off. The curved surface of the main body 10 is covered by a rubber coating 70, having an outer surface with knurls 71 for better grip. Of course, for larger lamps, which are not hand-held, no provisions for holding are needed.

The main body 10 is hollow, having a cylindrical cavity 11. Towards the front end of the main body 10, the cavity 11 widens abruptly into a accommodating space 12 at a shoulder 13. The accommodating space 12 has an opening to the outside of the main body 10 at the front end thereof. As shown in FIG. 1, the accommodating space 12 accommodates the light bulb 20. The light bulb 20 has a front side, through which light is emitted. The light filter 50 has a rear side facing the light bulb 20 and a front side. The light filter 50 covers the front side of the light bulb 20 and thus protects the light bulb 20 from being damaged. Even if no light filtering function is required, the light filter 50 still is used as a protecting glass.

Referring to FIG. 1, the light bulb 20 and the light filter 50 have diameters that are smaller than the diameter of the accommodating space 12 of the main body 10, so a circular gap 14 is left between the light bulb 20 with the light filter 50 and the main body 10. The holding ring 60 is laid around the opening of the accommodating space 12 at the front end of the main body 10. The holding ring 60 comprises an outer ring 61, which tightly surrounds the front end of the main body 10, and an inner ring 62, surrounded by the opening of the accommodating space 12. The inner ring 62 has a smaller diameter than the opening of the accommodating space 12, such that a gap is left between the inner ring 62 and the opening.

The inner ring 62 has a rear edge, which is bent inward to form a rim 63. The rim 63 holds the front side of the light filter 50, blocking the light filter 50 from falling out of the main body 10. Between the rim 63 and the front side of the light filter 50 an absorber 51 is inserted to absorb shocks.

Since the light bulb 20 has a smaller diameter than the accommodating space 12, it is movable therein. The light bulb 20 has a peripheral base 21. A spring 22 is inserted between the base 21 of the light bulb 20 and the shoulder 13 of the main body 10, pressing the light bulb 20 towards the front end of the main body 10. Another spring 23 between the front side of the light bulb 20 and the rear side of the light filter 50 keeps the light bulb 20 distant from the light filter 50.

The springs 22, 23 allow the light bulb 20 to move within the accommodating space 20 along the longitudinal axis. External shocks do not cause the light bulb 20 to bump against the light filter 50. Thus the light bulb 20 and the light filter 50 will not easily break or be damaged, when the lamp suffers from an external shock, e.g., by dropping it.

An important characteristic of the durable lamp of the present invention is the fan 30, located behind the light bulb 20, in the cavity 11. Several inlet holes 15 are bored through the rear end of the main body 10, and several exhaust holes 64 are bored through the holding ring 60. The inlet holes 15 and the exhaust holes 64 together with the gap 14 allow the cavity 11 and the accommodating space 12 to be ventilated along a ventilation path 80. The fan 30 sucks in air through the inlet holes 15 and pushes it beside the light bulb 20 through the exhaust holes 64, lowering the temperature of the light bulb 20 during operation thereof.

The advantages of the present invention are as follows:

1. Heat is dissipated effectively by the fan 30, lowering the operational temperature of the light bulb 20 and extending its lifetime.
2. Using the fan 30 allows for a reduced number of holes in the main body 10, simplifying the design thereof.
3. The main body 10 is kept small, thus allowing to use the lamp conveniently like a flashlight.
4. The light bulb 20 and the light filter 50 are arranged in a way that they will not easily break or be damaged, when the lamp suffers from an external shock.

In an alternative arrangement, the inlet holes 15 and the exhaust holes 64 are bored through the curved surface of the main body 10, respectively behind the fan 30 and in front of the light bulb 20. The flow of the ventilation path 80 is also reversible, by reversing the effect of the fan 30.

While the invention has been described with reference to a preferred embodiment thereof, it is to be understood that modifications or variations may be easily made without departing from the spirit of this invention which is defined by the appended claims.

I claim:

1. A durable lamp, comprising:

a hollow main body with a longitudinal axis and a front end, having an inner cavity, which towards said front end forms an accommodating space, which is open on said front end of said main body;

a light bulb, located in said accommodating space;

a fan, mounted in said cavity, for directing air from outside said main body through said cavity along a ventilation path that passes said light bulb, so as to cool said light bulb during operations;

a light filter, mounted in front of said light bulb a first spring between said light filter and said light bulb; and a second spring between said light bulb and said main body on a location behind said light bulb;

wherein said light bulb is movable within said accommodating space along said longitudinal axis.

2. A durable lamp, comprising:

a hollow main body with an inner cavity having a longitudinal axis and a front end portion forming an accommodating space which is open on a front end of said main body;

a light bulb, movably mounted in said accommodating space so as to be movable along the longitudinal axis; and a fan, mounted in said cavity, for directing air from outside said main body through said inner cavity along a ventilation path that passes said light bulb, so as to cool said light bulb during operation.

3. the durable lamp according to claim 2, further comprising a light filter, mounted in front of said light bulb.

4. the durable lamp according to claim 3 further comprising a first spring interposed between said light filter and said light bulb.

5. The durable lamp according to claim 4 further comprising a second spring interposed between said light bulb and said main body at a location behind said light bulb.

6. The durable lamp according to claim 2 wherein the light bulb comprises an ultraviolet light bulb.

7. The durable lamp according to claim 1 wherein the light bulb comprises an ultraviolet light bulb.

* * * * *